US008643550B2

(12) United States Patent
Chiu et al.

(10) Patent No.: US 8,643,550 B2
(45) Date of Patent: Feb. 4, 2014

(54) FLEXIBLE ANTENNA

(75) Inventors: Tsung-Wen Chiu, Xin-Dian (TW); Fu-Ren Hsiao, Taipei County (TW); Chih-Fan Chen, Taipei County (TW); Po-Sheng Chen, Taipei County (TW)

(73) Assignee: Advanced Connectek Inc., Taipei County (TW)

( * ) Notice: Subject to any disclaimer, the term of this patent is extended or adjusted under 35 U.S.C. 154(b) by 228 days.

(21) Appl. No.: 13/070,364

(22) Filed: Mar. 23, 2011

(65) Prior Publication Data

US 2012/0068888 A1 Mar. 22, 2012

(30) Foreign Application Priority Data

Oct. 15, 2010 (TW) ..... 99135181 A

(51) Int. Cl.
*H01Q 1/38* (2006.01)

(52) U.S. Cl.
USPC ..... 343/700 MS; 343/702; 343/850; 343/853

(58) Field of Classification Search
USPC ..... 343/700, 702, 850, 853
See application file for complete search history.

(56) References Cited

U.S. PATENT DOCUMENTS

| | | | | |
|---|---|---|---|---|
| 5,907,304 | A * | 5/1999 | Wilson et al. | 343/700 MS |
| 6,788,266 | B2 * | 9/2004 | St. Hillaire et al. | 343/770 |
| 7,724,204 | B2 * | 5/2010 | Annamaa et al. | 343/906 |
| 2011/0287589 | A1 * | 11/2011 | Aoki et al. | 438/126 |
| 2012/0112966 | A1 * | 5/2012 | Tayama et al. | 343/700 MS |
| 2012/0262357 | A1 * | 10/2012 | Kato et al. | 343/788 |

* cited by examiner

*Primary Examiner* — Allyson Trail
(74) *Attorney, Agent, or Firm* — Schmeiser Olsen & Watts LLP

(57) ABSTRACT

A flexible antenna comprises a filmed layer, a flexible radiation conductor and a support member. The flexible radiation conductor has a crooked form and a feeder terminal. The filmed layer covers the upper surface of the flexible radiation conductor. The support member has a through-hole. The lower surface of the flexible radiation conductor is stuck to the upper surface of the support member. The feeder terminal is inserted through the through-hole to protrude from the lower surface of the support member. The flexible radiation conductor and the crooked feeder terminal thereof replace the conventional radiation conductor circuit layer and metallic contact terminal to overcome the problem that the conventional contact terminal damages the radiation conductor layer and protrudes the filmed layer. Further, the present invention integrates FPC and LDS technologies to enable the flexible radiation conductor to be arbitrarily stuck to complicated planes or complicated curved surfaces.

6 Claims, 2 Drawing Sheets

FLEXIBLE ANTENNA

BACKGROUND OF THE INVENTION

1. Field of the Invention

The present invention relates to a flexible antenna, particularly to an antenna with a flexible radiation conductor.

2. Description of the Related Art

The embedded antenna has been evolved from a single- and narrow-band system to a multi- and broad-band system. The multi-band system needs components miniaturized as much as possible and thus is hard to fabricate. The current market demands that the wireless transmission device should have smooth appearance without any antenna exposed externally. Therefore, the integration of the antenna system and the appearance has become a critical problem in designing a wireless transmission device.

When the contact terminals are inserted into the holes of the plastic casing in fabricating wireless transmission devices, the inserting force is hard to precisely control. Thus, the contact terminals are likely to directly impact the radiation conductor and the filmed layer, which may damage the radiation conductor and protrude the filmed layer.

If the radiation conductor is realized with FPC (Flexible Printed Circuit), there is a drawback that FPC can only attach to a plane or a simple curved surface. If the radiation conductor is realized with LDS (Laser Direct Structuring), there is a drawback that LDS is expensive and has low productivity and poor yield.

SUMMARY OF THE INVENTION

One objective of the present invention is to provide a flexible antenna, wherein a flexible radiation conductor and a feeder terminal thereof are respectively used as the radiation conductor circuit layer and the contact terminal, whereby is overcome the problem that the conventional contact terminal damages the radiation conductor layer and protrudes the filmed layer, and whereby is promoted the productivity and yield.

Another objective of the present invention is to provide a flexible antenna, wherein the FPC technology is integrated with the LDS technology, and wherein the radiation conductor coated with the filmed layer is attached to the surface of the support member, whereby the flexible radiation conductor can be arbitrarily stuck to complicated planes or complicated curved surface.

A further objective of the present invention is to provide a flexible antenna, wherein a flexible filmed layer and a flexible radiation conductor circuit layer are stuck to the surface of a plastic casing, and wherein the semi-finished product is fabricated into a finished antenna via embossing, compression-film-forming, cutting, trimming and injection-molding processes, and wherein the filmed layer can improve the wear resistance and chemical resistance of the radiation conductor.

To achieve the abovementioned objectives, the present invention proposes a flexible antenna comprising a filmed layer, a flexible radiation conductor and a support member. The flexible radiation conductor has a crooked form and a feeder terminal. The filmed layer covers the upper surface of the flexible radiation conductor. The support member has a through-hole. The lower surface of the flexible radiation conductor is stuck to the upper surface of the support member. The feeder terminal is inserted through the through-hole to protrude from the lower surface of the support member.

The present invention uses the flexible radiation conductor and the crooked feeder terminal thereof to replace the conventional radiation conductor circuit layer and metallic contact terminal to avoid the problem that the metallic contact terminal damages the radiation conductor layer and protrudes the filmed layer, improve the wear resistance and chemical resistance of the radiation conductor, and promote the yield of production.

Further, the present invention integrates FPC and LDS technologies to enable the flexible radiation conductor to be arbitrarily stuck to complicated planes or complicated curved surfaces.

Furthermore, the present invention adopts the flexible filmed layer and the flexible radiation conductor to prevent from the damage caused by the embossing, compression-filming, cutting, trimming, or mold-injection process. Moreover, the present invention uses the filmed layer to improve the wear resistance and chemical resistance of the radiation conductor.

Below, the embodiments are described in detail to make easily understood the technical contents of the present invention.

DETAILED DESCRIPTION OF THE INVENTION

Figure 1:
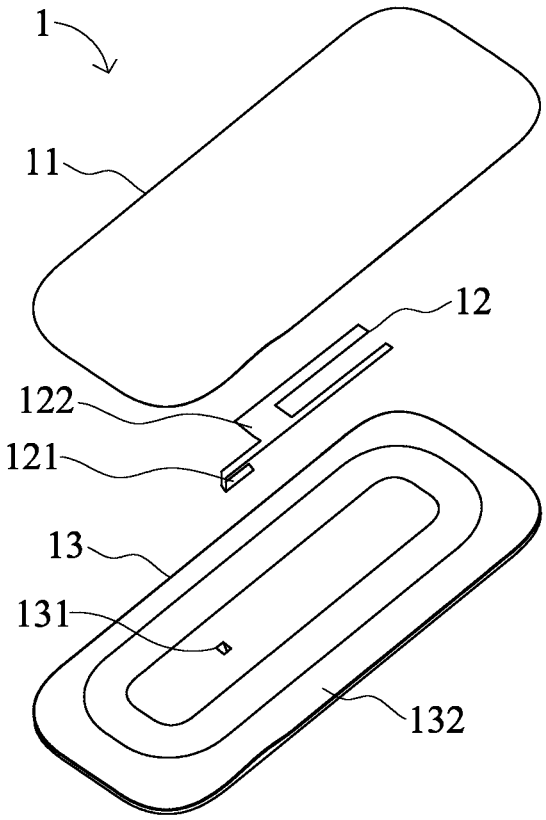
FIG. 1 is a perspective exploded view of a flexible antenna according to a first embodiment of the present invention.
Figure 2:
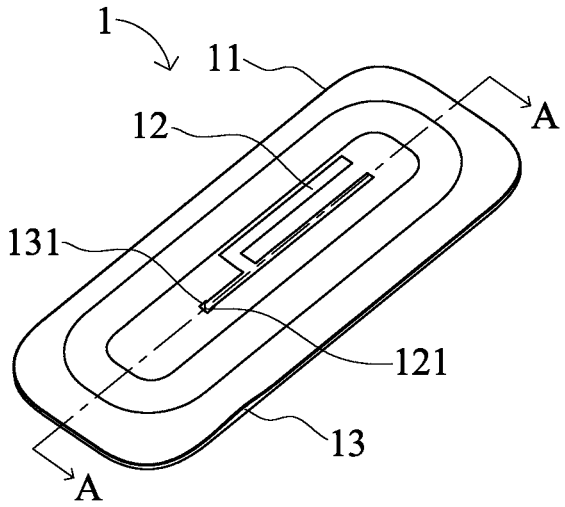
FIG. 2 is a perspective top view of a flexible antenna according to the first embodiment of the present invention.

Refer to FIG. 1 and FIG. 2. FIG. 1 is a perspective exploded view of a flexible antenna according to a first embodiment of the present invention. FIG. 2 is a perspective top view of a flexible antenna according to the first embodiment of the present invention. The flexible antenna 1 of the present invention comprises a filmed layer 11, a flexible radiation conductor 12 and a support member 13. The flexible radiation conductor 12 has a crooked form and has a feeder terminal 121 at one end of one side thereof.

In assemblage, a first lower surface 111 (not shown in the drawings) of the filmed layer 11 is attached to an upper surface 122 of the flexible radiation conductor 12. The filmed layer 11 is made of a polyester film (Mylar). Both the filmed layer 11 and the flexible radiation conductor 12 are made of soft material. Therefore, the first lower surface 111 of the filmed layer 11 completely adheres to the upper surface 122 of the flexible radiation conductor 12. The support member 13 is made of a non-conductive material. In this embodiment, the support member 13 is made of a plastic material. The support member 13 has a through-hole 131. A second lower surface 123 (not shown in the drawings) of the flexible radiation conductor 12 is stuck to a second upper surface 132 of the support member 13. The feeder terminal 121 is inserted through the through-hole 121 and then stuck to a third lower surface 133 (not shown in the drawings) of the support member 13. As the flexible radiation conductor 12 is designed to have an about horizontal U shape, the flexible radiation conductor 12 and the feeder terminal 121 can be tightly stuck to the surface of the support member 13. Thereby, the contact surfaces of the flexible radiation conductor 12 and the support member 13 are completely sealed.

In the first embodiment, the filmed layer 11 has an about rectangular shape with a length of about 70 mm, a width of about 28 mm and a thickness of about 0.05 mm. The flexible radiation conductor 12 has an about horizontal U shape and extends serpentinely to form an about rectangular radiation conductor path. The long rectangle of the about horizontal U shape has a length of about 16 mm and a width of about 0.5 mm. The short rectangle of the about horizontal U shape is the feeder terminal 121 having a length of about 2 mm and a width of about 0.5 mm. The rectangular extension of the flexible radiation conductor 12 has a length of about 12 mm and a width of about 1 mm. The support member 13 has an about rectangular shape similar to the filmed layer 11 and having a length of about 70 mm, a width of about 28 mm and a thickness of about 2 mm.

Figure 3:
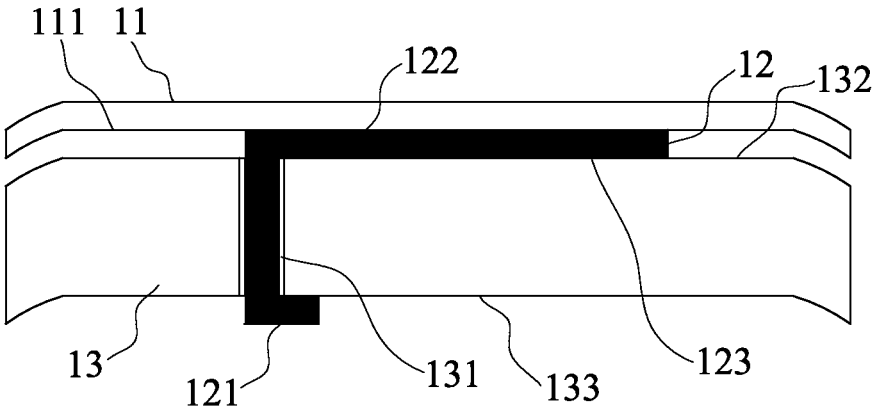
FIG. 3 is a side view of a flexible antenna according to the first embodiment of the present invention.

Refer to FIG. 3 a side view of a flexible antenna according to the first embodiment of the present invention. The flexible antenna of the present invention can apply to various wireless transmission devices. In the first embodiment, the flexible antenna 1 is accommodated in a mobile phone. The above-mentioned side view is taken along Line A-A in the above-mentioned perspective top view.

In the first embodiment, the through-hole 131 is formed in the support member 13. In assemblage, the second lower surface 123 of the flexible radiation conductor 12 is stuck to the second upper surface 132 of the support member 13. The crooked feeder terminal 121 is inserted through the through-hole 131 and then stuck to the third lower surface 133 of the support member 13. As the flexible radiation conductor 12 is designed to have an about horizontal U shape, the flexible radiation conductor 12 and the feeder terminal 121 can be respectively tightly stuck to the second upper surface 132 and the third lower surface 133 of the support member 13. Thereby, the contact surfaces of the flexible radiation conductor 12 and the support member 13 are completely sealed.

Figure 4:
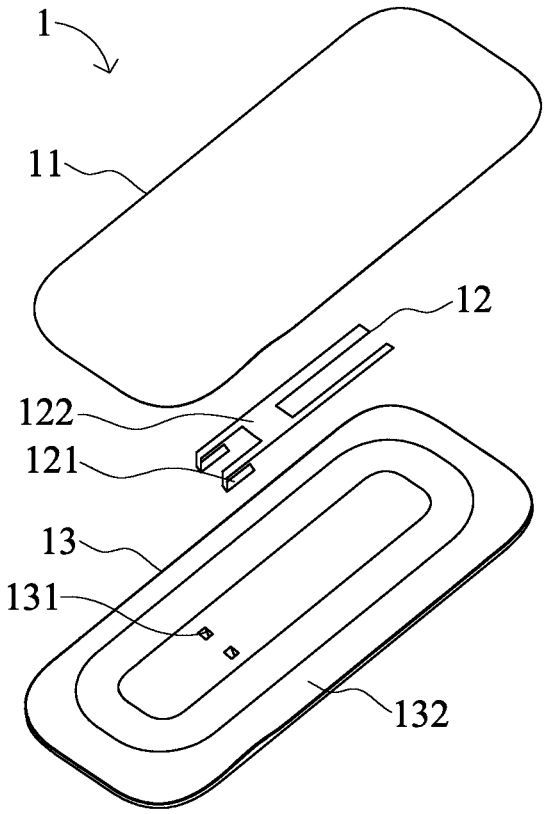
FIG. 4 is a perspective exploded view of a flexible antenna according to a second embodiment of the present invention.

Refer to FIG. 4 a perspective exploded view of a flexible antenna according to a second embodiment of the present invention. The second embodiment is basically similar to the first embodiment but different from the first embodiment in that the support member 13 has two through-holes 131. As the flexible radiation conductor 12 is made of a flexible material, the crooked feeder terminal 121 can be easily inserted through the through-holes 131 of the support member 13 and then tightly stuck to surface of the support member 13. When the design of the wireless transmission device needs more through-holes 131, additional through-holes 131 are formed in the support member 13, and then the crooked feeder terminals 121 of the flexible radiation conductor 12 are sequentially inserted through the corresponding through-holes 131 of the support member 13 and then tightly stuck to the surface of the support member 13.

The present invention possesses utility, novelty and non-obviousness and meets the condition for a patent. Thus, the Inventors file the application. It is appreciated if the patent is approved fast.

The embodiments described above are only to exemplify the present invention but not to limit the scope of the present invention. Any equivalent modification or variation according to the spirit of the present invention is to be also included within the scope of the present invention.

What is claimed is:

1. A flexible antenna comprising:

a filmed layer;

a flexible radiation conductor having a crooked form and a feeder terminal, wherein said filmed layer covers an upper surface of said flexible radiation conductor; and a support member having a through-hole, wherein a lower surface of said flexible radiation conductor is stuck to an upper surface of said support member, and wherein said feeder terminal is inserted through said through-hole to protrude from said support member and then stuck to a lower surface of said support member;

wherein said feeder terminal is parallel to said upper surface of said flexible radiation conductor;

wherein a distance between said lower surface of the flexible radiation conductor and an upper surface of said feeder terminal is equal to a thickness of the support member.

2. The flexible antenna according to claim 1, wherein said filmed layer is made of a polyester film (Mylar).

3. The flexible antenna according to claim 1, wherein contact surfaces of said filmed layer and said flexible radiation conductor are completely sealed.

4. The flexible antenna according to claim 1, wherein contact surfaces of said flexible radiation conductor and said support member are completely sealed.

5. The flexible antenna according to claim 1, wherein said flexible radiation conductor is crooked to have an about horizontal U shape.

6. The flexible antenna according to claim 1, wherein said support member is made of a non-conductive material.

* * * * *